US005453210A

United States Patent [19]

Bardasz et al.

[11] Patent Number: 5,453,210

[45] Date of Patent: Sep. 26, 1995

[54] METHOD OF TREATING THE PRODUCTS OF COMBUSTION OF LANDFILL GAS

[75] Inventors: Ewa A. Bardasz, Mentor; William K. S. Cleveland, Mentor on the Lake, both of Ohio

[73] Assignee: The Lubrizol Corporation, Wickliffe, Ohio

[21] Appl. No.: 186,190

[22] Filed: Jan. 24, 1994

[51] Int. Cl.[6] ..... C10M 141/00

[52] U.S. Cl. ..... 252/18; 252/33.4; 252/50; 252/56 R; 252/25

[58] Field of Search ..... 252/18, 33.4, 25, 252/50, 56 R

[56] References Cited

U.S. PATENT DOCUMENTS

| | | | |
|---|---|---|---|
| 3,634,051 | 1/1972 | Phillips | 44/51 |
| 3,969,237 | 7/1976 | Andress, Jr. | 252/49.9 |
| 4,157,247 | 6/1979 | Collins et al. | 55/31 |
| 4,384,552 | 5/1983 | Landers et al. | 123/3 |
| 4,409,102 | 10/1983 | Tanner | 210/603 |
| 4,566,278 | 1/1986 | Force | 60/618 |
| 4,648,333 | 3/1987 | Mudd et al. | 110/346 |
| 4,904,279 | 2/1990 | Kanne et al. | 44/70 |
| 4,906,252 | 3/1990 | Gutierrez et al. | 44/63 |
| 4,907,964 | 3/1990 | Howorth et al. | 431/202 |
| 5,034,020 | 7/1991 | Epperley et al. | 44/358 |
| 5,059,405 | 10/1991 | Watson et al. | 423/210 |
| 5,125,931 | 6/1992 | Schulz | 44/552 |
| 5,139,365 | 8/1992 | Chesner | 210/751 |

*Primary Examiner*—Jacqueline V. Howard

*Attorney, Agent, or Firm*—James L. Cordek; Frederick D. Hunter; Joseph P. Fischer

[57] ABSTRACT

Disclosed is a method of extending lubricant life and engine life in a gas engine that utilizes landfill gas which comprises treating deleterious landfill gas components and combustion products of said landfill gas with a lubricant composition comprising a major amount of an oil of lubrication viscosity and a minor amount of an additive composition comprising;

(A) at least one metal overbased composition and (B) at least one inhibitor.

27 Claims, No Drawings

METHOD OF TREATING THE PRODUCTS OF COMBUSTION OF LANDFILL GAS

FIELD OF THE INVENTION

This invention relates to a method of extending lubricant life in a gas engine as well as the engine itself when a landfill gas is utilized. Landfill gas contains components that shorten the time interval between oil changes. This time interval is further shortened by the products of combustion of landfill gas. These deleterious components of landfill gas as well as the products of combustion or by-products are ameliorated with a lubricating oil composition that contains an additive composition. This additive composition provides for a longer duration between oil changes and results not only in a cost savings of oil used but also protects the engine parts that are exposed to these deleterious components and by-products.

Typical passenger car motor oils (PCMO) are normally high total base number (TBN) oils and have been used as a lubricating composition in engines powered by landfill gas. High TBN oil formalations of typical PCMO's do not control the acidic attack on the oil nor on the engine parts. The results are that the life of the oil is brief which causes high oil consumption and that chemical milling of the engine is observed on both ferrous and non ferrous engine parts which leads to shorter engine life.

BACKGROUND OF THE INVENTION

Gases are generated in landfills and can cause serious problems. Through the naturally occurring decomposition processes that occur within the waste contained in a landfill, a number of gaseous products are generated. These gaseous products, if allowed to migrate uncontrolled from a landfill, may result in dangerous conditions within buildings that the gas may enter. Uncontrolled release of the gas to the atmosphere may cause air pollution.

Solid waste initially decomposes aerobically, and the primary gas product is carbon dioxide. As the oxygen is depleted, anaerobic microorganisms begin to dominate. These bacteria continue to produce carbon dioxide, but additionally, produce methane. Additional compounds are produced, and additional chemicals are released into the landfill by volatilization.

Typically, landfills are covered by a combination capping system. This system can include a series of bentonite clays and a polymeric (typically polyvinyl chloride (PVC)) liner. This liner system has the purpose of containing landfill gas and odors. Landfill gas is collected under the liners and directed to vents that are vented to the atmosphere. These vents are equipped with flares to bum off the gas in order to prevent odor problems.

The dilemma with this method of disposal of landfill gas is that one problem (the flaring of landfill gas produces noxious by-products) is exchanged for another (the migration of untreated landfill gas into the atmosphere). This invention is directed to landfill gas as a fuel source. Consequently, this invention is a partial solution to what to do with the landfill gas being produced.

U.S. Pat. No. 3,634,051 (Phillips, Jan. 11, 1972) relates to both inorganic metallic and organic amine additives for combustible fuels. More specifically, the reference is concerned with fuel additives that significantly increase fuel economy as well as resulting in more complete combustion and higher flame temperatures. In addition, the additives typically act as corrosion and sulfation inhibitors in a fuel mixture, thereby performing a detergent function as well as improving the combustion process. Inorganic compounds of the metal zirconium, including the potassium, sodium, and lithium salts when function as well as improving the combustion process. Inorganic compounds of the metal zirconium, including the potassium, sodium, and lithium salts when present in trace quantities in a fuel mixture can increase fuel economy from about 5 to 20 percent, or more.

U.S. Pat. No. 3,969,237 (Andress, Jr., Jul. 13, 1976) relates to organic compositions and, relates more particularly to organic compositions in the form of liquid and solid hydrocarbon-containing materials which normally tend to react with and corrode copper surfaces under conditions of use. Still more particularly, the reference relates to improved organic compositions in the form of lubricating oils, greases, fuels and solvents, which in their uninhibited state, tend to react with and corrode copper surfaces with which they may come into contact in performing their intended function.

U.S. Pat. No. 4,157,247 (Collins, III et al., Jun. 5, 1979) relates to the removal of impurities from landfill gas. Decomposition of the refuse within a sanitary landfill produces landfill gas which contains methane and impurities. The impurities may include carbon dioxide, water and various hydrocarbons.

Although the concentration of methane in landfill gas varies, methane may comprise about 50 percent by volume of the landfill gas. In some instances, the landfill gas is used without removal of the impurities, and in other instances, the concentration of the methane is increased by removing some, or substantially all, of the impurities. Landfill gas contains chlorinated hydrocarbons in trace amounts, such as 0.02% to 0.03% by volume which produce corrosive hydrogen chloride gas.

U.S. Pat. No. 4,384,552 (Landers et al, May 24, 1983) relates to gas producing and handling systems and to such systems which produce a combustible gas for burning in an internal combustion engine coupled to an electrical generator.

There are presently many instances where a combustible gaseous fuel, such as methane, is produced as a by-product of other processes, such as in anaerobic digesters. It has long been known that anaerobic digesters can be utilized in decomposing organic waste, such as animal manure, so that the resulting decomposed matter is less offensive and less damaging to the environment. Anaerobic decomposition produces various gaseous by-products including carbon dioxide and combustible methane gas.

A major problem encountered in attempts to utilize the methane gas produced by the digester concerns the need to store the gas when the total amount of gas being produced by the digester is either not used fully by the various appliances utilizing the gas or is not being combusted in the internal gas engine for driving the electrical generator.

This reference is directed to a gas producing and handling system allowing a user to consume all of the gas produced by a variable production supply reservoir in an internal combustion engine coupled to an electrical generator.

U.S. Pat. No. 4,409,102 (Tanner, Oct. 11, 1983) relates to a method for purifying methane gas of a stream constituted of methane gas, carbon dioxide, and, perhaps, hydrogen sulfide. The reference effects purification of the stream to get high quality methane by passing the stream to be purified into contact with water to absorb the contaminants. This absorption step is undertaken within a prescribed pressure range corresponding to pressure required for desired purity in view of the limitations of the water flow rate and time of contact of the water stream and the stream being purified. The feed stream is compressed to the pressure at which absorption takes place. No purified gas leaves the system until the pressure in the absorber has been reached and consequential methane purity assured.

U.S. Pat. No. 4,566,278 (Force, Jan. 28, 1986) relates to a method and system for improving the quality of digester methane gas to enable it to be used effectively and efficiently as a fuel for internal combustion engine—generator systems.

Digester methane gas is generally comprised of a mixture of methane (50–70%), carbon dioxide (30–50%) and varying lesser amounts of oxygen, nitrogen, water, ammonia, hydrogen sulfide and mercaptans and such gas may have a heating value of 400–500 Btu per cubic foot. Although it is possible to bum raw digester methane in internal combustion engines, the efficiency of such engines is drastically reduced from that achieved when pipeline methane (1,000 Btu/ft$^3$) is utilized.

U.S. Pat. No. 4,904,279 (Kanne et al, Feb. 27, 1990) relates to a hydrocarbon fuel having properties for suppression of particulate emissions during combustion. In particular, the present reference relates to hydrocarbon fuel compositions comprising a hydrocarbon fuel heavier than gasoline containing at least two organically esterified carbonates added thereto to reduce the particulate emissions resulting from the combustion of the hydrocarbon fuel. At least one of the carbonate constituents is of the formula:

$$R^1O-\overset{\overset{\displaystyle O}{\|}}{C}-OR^2$$

wherein $R^1$ and $R^2$ are the same or different monovalent organic radicals with between 1 and 10 carbon atoms, with the second carbonate compound being a dicarbonate having the general formula:

$$R^3O-\overset{\overset{\displaystyle O}{\|}}{C}-O-\overset{\overset{\displaystyle O}{\|}}{C}-OR^4$$

wherein $R^3$ and $R^4$ are the same or different monovalent organic radicals with between 1 and 10 carbon atoms.

U.S. Pat. No. 4,906,252 (Gutierrez et al, Mar. 6, 1990) relates to dispersants used in lubricating oil compositions that have the primary function of dispersing particulate materials formed in the engine and keeping those materials in dispersion. As a rule of thumb, the dispersants having the higher molecular weight have higher efficiency in maintaining particulates in dispersion than those with lower molecular weight. Higher molecular weight, however, often causes increased viscosity in the finished formulation. This result may be a benefit in that high temperature lubricating properties are maintained. Increased viscosity may, however, cause increased pumping losses in an engine and result in lower gas mileage. Increased viscosity may, however, cause increased pumping losses in an engine and result in lower gas mileage. Increased viscosity at low temperature may also cause substantial problems in attempting to start engines during the winter. Compositions containing the reference adduct show excellent dispersant capabilities and yet provide superior cold start operation.

U.S. Pat. No. 5,059,405 (Watson et al, Oct. 22, 1991) relates to plants processing landfill gases to produce high BTU methane gas suitable for use in commercial pipelines that generally have a waste gas stream composed of very high purity carbon dioxide gas. There have been problems marketing the waste carbon dioxide for many reasons, not the least of which is its procurement from a source as obnoxious as a landfill. Another equally major problem is the high concentration of corrosive compounds generated from trace components in the landfill gas. These compounds apparently are a common source of the recurring problems involving the short and long term failures of internal reciprocating engines. In order to assure the high quality purity of the carbon dioxide product, any carbon dioxide produced by landfill gases must be subjected to incineration and to the latest filtration, absorption, and scrubbing technologies available.

U.S. Pat. No. 5,034,020 (Epperly et al, Jul. 23, 1991) relates to improving the performance of internal combustion engines utilizing hydrocarbon fuels including gasoline, gasohol and diesel fuel, and, more particularly, to the use of additives and fuels which bum more efficiently and with reduced noxious emissions.

U.S. Pat. No. 5,125,931 (Schulz, Jun. 30, 1992) relates to the disposal of sewage sludge wastes. This reference provides a process for forming briquettes from a mixture of caking coal fines and sewage sludge as principal ingredients and for utilization of the briquettes in a process for the generation of industrially useful products, such as hydrogen, synthesis gas, fuel gas, heat and electrical energy.

SUMMARY OF THE INVENTION

This invention is directed to a method of extending lubricant life and engine life in a gas engine that utilizes landfill gas as the fuel which comprises treating combustion products of said landfill gas as well as any deleterious components of the landfill gas with a lubricant composition comprising a major amount of an oil of lubrication viscosity and a minor amount of an additive composition comprising;

(A) at least one metal overbased composition and (B) at least one inhibitor.

DETAILED DESCRIPTION OF THE INVENTION

Landfill gas is a natural by-product from the decomposition of refuse in a landfill and is composed primarily of methane and carbon dioxide. Landfill gas as a fuel source for compressed natural gas engines is revolutionary because it takes what is normally considered waste and creates an alternative fuel. Landfill gas also contains chloro-fluorocarbons (CFC's) released from refuse containing such materials as styrofoam and aerosol cans. When CFC's are burned in the combustion process, they produce halo acids such as hydrochloric acid and halooxy acids such as chloric acid, $HClO_2$ and hypochlorous acid, HClO.

These products of combustion, halo acids and halooxy acids have a deleterious effect on the engine oil. Normal engine oils require changing more often when landfill gas is combusted. This invention utilizes additives that combat the deleterious effect of halo acids and halooxy acids. So much so that the engine oil is permitted to remain in use for longer periods of time in addition to extending the life of the engine itself. The engine oil composition of this invention comprises a major amount of an oil of lubricating viscosity and a minor amount of an additive composition comprising (A) at least one metal overbased composition and (B) at least one inhibitor.

A synergism exists in the combination of the (A) and (B) components.

The Oil of Lubricating Viscosity

The oils utilized in this invention can be natural oils or synthetic oils. Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)- sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(A) The Metal Overbased Composition

Overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The overbased salts used as (A) in this invention usually have metal ratios of at least about 3:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, IIA, and IIB metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfonic, partial ester sulfuric, sulfurous and thiosulfuric acid. Generally they are salts of carboxylic or aliphatic sulfonic acids.

The carboxylic sulfonic acids include the mono- or polynuclear aromatic or cycloaliphatic compounds. The oil-soluble sulfonates can be represented for the most part by the following formulae:

$$[R_x—T—(SO_3)_y]_zM_b \quad (I)$$

$$[R^1(SO_3)_a]_dM_b \quad (II)$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.: R in Formula I is an aliphatic group such as alkyl, alkenyl, alkoxy, alkoxyalkyl, carboalkoxyalkyl, etc.; x is at least 1, and $R_x$+T contains a total of at least about 15 carbon atoms, $R^1$ in Formula II is an aliphatic radical containing at least about 15 carbon atoms and M is either a metal cation or hydrogen. Examples of type of the $R^1$ radical are alkyl, alkenyl, alkoxyalkyl, carboalkoxyalkyl, etc. Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and $R^1$ in the above formulae can also contain other inorganic or organic substituents in addition to those enumerated above such as, for example, hydroxy, mercapto, halogen, nitro, amino, nitroso, sulfide, disulfide, etc. In Formula I, x, y, z and b are at least 1, and likewise in Formula II, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, napthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which has been alkylated with propylene tetramers or isobutene trimers to introduce 1,2,3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 at seq. published by John Wiley & Sons, N.Y. (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3.595,790; and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB overbased salts of the above-described synthetic and petroleum sulfonic acids are typically useful in making (A) of this invention.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkyl-or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyloctahydroindene carboxylic acid, palmitic acid, commercially available mixtures of two or more carboxylic acids such as tall oil acids, rosin acids, and the like.

A typical group of oil-soluble carboxylic acids useful in preparing the salts used in the present invention are the oil-soluble aromatic carboxylic acids.

These acids are represented by the general formula:

$$(R^*)_g-(Ar^*)\left(\begin{matrix} X \\ \| \\ C-XH \end{matrix}\right)_f \quad (III)$$

wherein R* is an aliphatic hydrocarbon-based group of at least 4 carbon atoms, and no more than about 400 aliphatic carbon atoms, g is an integer from one to four, Ar* is a polyvalent aromatic hydrocarbon nucleus of up to about 14 carbon atoms, each X is independently a sulfur or oxygen atom, and f is an integer of from one to four with the proviso that R* and g are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylene-propylene copolymers, and the like. Likewise, the group Ar* may contain nonhydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

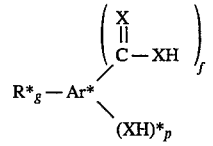

(IV)

wherein R*, X, Ar*, f and g are as defined in Formula III and p* is an integer of 1 to 4, usually 1 or 2. Within this group, an especially preferred class of oil-soluble carboxylic acids are those of the formula:

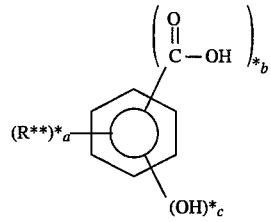

(V)

wherein R** in Formula V is an aliphatic hydrocarbon group containing at least 4 to about 400 carbon atoms, a* is an integer of from 1 to 3, b* is 1 or 2, c* is zero, 1, or 2 and preferably 1 with the proviso that R** and a* are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms.

The carboxylic acids corresponding to Formulae IV–V above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791 which are incorporated by reference herein for their disclosures of acids and methods of preparing overbased salts.

Another type of overbased carboxylate salt used in making (A) of this invention are those derived from alkenyl succinates of the general formula:

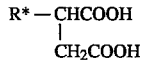

(VI)

wherein R* is as defined above in Formula IV. Such salts and means for making them are set forth in U.S. Pat. Nos. 3,271,130, 3,567,637 and 3,632,510, which are hereby incorporated by reference in this regard.

Other patents specifically describing techniques for making overbased salts of the hereinabove-described sulfonic acids, carboxylic acids, and mixtures of any two or more of these include U.S. Pat. Nos. 2,501,73 1; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,296; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

In the context of this invention, phenols are considered organic acids. Thus, overbased salts of phenols (generally known as phenates) are also useful in making (B-1) of this invention are well known to those skilled in the art. The phenols from which these phenates are formed are of the general formula:

$$(R^*)_g(Ar^*)—(XH)_f \quad \text{(VII)}$$

wherein R*, g, Ar*, X and f have the same meaning and preferences are described hereinabove with reference to Formula III. The same examples described with respect to Formula III also apply.

A commonly available class of phenates are those made from phenols of the general formula:

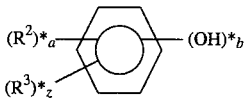

(VIII)

wherein a* is an integer of 1–3, b* is of 1 or 2, z* is 0 or 1, $R^2$ in Formula VIII is a hydrocarbyl-based substituent having an average of from 4 to about 400 aliphatic carbon atoms and $R^3$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Generally Group IIA overbased salts of the above-described carboxylic acids are typically useful in making (A) of this invention.

Component (A) may also be a borated complex of an overboard metal sulfonate, carboxylates or phenate. Borated complexes of this type may be prepared by heating the overbased metal sulfonate, carboxylate or phenate with boric acid at about 50°–100° C., the number of equivalents of boric acid being roughly equal to the number of equivalents of metal in the salt.

The method of preparing metal overbased compositions in this manner is illustrated by the following examples.

Example (A)-1

A mixture consisting essentially of 480 pans of a sodium petrosulfonate (average molecular weight of about 480), 84 parts of water, and 520 parts of mineral oil is heated at 100° C. The mixture is then heated with 86 pans of a 76% aqueous solution of calcium chloride and 72 parts of lime (90% purity) at 100° C. for two hours, dehydrated by heating to a water content of less than about 0.5%, cooled to 50° C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The tiltrate is found to have a calcium sulfate ash content of 16% and a metal ratio of 2.5. A mixture of 1305 parts of the above carbonated calcium petrosulfonate, 930 pans of mineral oil, 220 parts of methyl alcohol, 72 parts of isobutyl alcohol, and 38 parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number of 32–39. The resulting product is then heated to 155° C. during a period of nine hours to remove the alcohol and filtered at this temperature. The flitrate is characterized by a calcium sulfate ash content of about 40% and a metal ratio of about 12.2.

Example (A)-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol, and pentanol) and excess lime (5.6 equivalents per equivalent of the acid). The solution has a sulfur content of 1.7%, a calcium content of 12.6% and a base number of 336. To 950 grams of the solution, there is added 50 grams of a polyisobutene (molecular weight of 1000)-substituted succinic anhydride (having a saponification number of 100) at 25° C. The mixture is stirred, heated to 150° C., held at that temperature for 0.5 hour, and filtered. The tiltrate has a base number of 315 and contains 35.4% of mineral oil.

Example (A)-3

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°–165° C. for about 30 minutes and filtered to yield an oil solution of the desired basic sodium sulfonate having a metal ratio of about 7.75. This solution contains 12.4% oil.

Example (A)-4

To a mixture comprising 125 parts of low viscosity mineral oil and 66.5 parts of heptylphenol heated to about 38° C. there is added 3.5 pans of water. Thereafter, 16 parts of paraformaldehyde are added to the mixture at a uniform rate over 0.75 hour. Then 0.5 parts of hydrated lime are added and this mixture is heated to 80° C. over a 1 hour period. The reaction mixture thickens and the temperature rises to about 116° C. Then, 13.8 parts of hydrated lime are added over 0.75 hour while maintaining a temperature of about 80°–90° C. The material is then heated to about 140° C. for 6 to 7 hours at a reduced pressure of about 2–8 torr to remove substantially all water. An additional 40 parts of mineral oil are added to the reaction product and the resulting material is filtered. The filtrate is a concentrated oil solution (70% oil) of the substantially neutral calcium salt of the heptylphenol-formaldehyde condensation product. It is characterized by calcium content of about 2.2% and a sulfate ash content of 7.5%.

Example (A)-5

A solution of 3192 pans (12 equivalents) of a polyisobutene-substituted phenol, wherein the polyisobutene substituent has a molecular weight of about 175, in 2400 pans of mineral is heated to 70° C. and 502 pans (12 equivalents) of solid sodium hydroxide is added. The material is blown with nitrogen at 162° C. under vacuum to remove volatiles and is then cooled to 125° C. and 465 parts (12 equivalents) of 40% aqueous formaldehyde is added. The mixture is heated to 146° C. under nitrogen, and volatiles are finally removed again under vacuum. Sulfur dichloride, 618 parts (6 equivalents), is then added over 4 hours. Water, 1000 pans, is added at 70° C. and the mixture is heated to reflux for 1 hour. All volatiles are then removed under vacuum at 155° C. and the residue is filtered at that temperature, with the addition of a filter aid material. The flitrate is the desired product (59% solution in mineral oil) containing 3.56% phenolic hydroxyl and 3.46% sulfur.

Example (A)-6

To a mixture of 3192 pans (12 equivalents) of tetrapropenyl-substituted phenol, 2400 parts of mineral oil and 465 pans (6 equivalents) of 40% aqueous formaldehyde at 82° C., is added, over 45 minutes, 960 pans (12 equivalents) of 50% aqueous sodium hydroxide. Volatile materials are removed by stripping as in Example (A)-4, and to the residue is added 618 parts (12 equivalents) of sulfur dichloride over 3 hours. Toluene, 1000 parts, and 1000 pans of water are added and the mixture is heated under reflux for 2 hours. Volatile materials are then removed at 180° C. by blowing with nitrogen and the intermediate is filtered.

To 1950 pans (4 equivalents) of the intermediate thus obtained is added 135 parts of the polyisobutenyl succinic anhydride of Example (A)-2. The mixture is heated to 51° C., and 78 pans of acetic acid and 431 pans of methanol are added, followed by 325 pans (8.8 equivalents) of calcium hydroxide. The mixture is blown with carbon dioxide and is finally stripped with nitrogen blowing at 158° C. and filtered while hot, using a filter aid. The tiltrate is a 68% solution in mineral oil of the desired product and contains 2.63% sulfur and 22.99% calcium sulfate ash.

Example (A)-7

A reaction mixture comprising about 512 pans by weight of a mineral oil solution containing about 0.5 equivalent of a substantially neutral magnesium salt of an alkylated salicylic acid wherein the alkyl group has an average of about 18 aliphatic carbon atoms and about 30 pans by weight of an oil mixture containing about 0.037 equivalent of an alkylated benzenesulfonic acid together with about 15 pans by weight (about 0.65 equivalent) of a magnesium oxide and about 250 parts by weight of xylene is added to a flask and heated to a temperature of about 60° C. to 70° C. The reaction mass is subsequently heated to about 85° C. and approximately 60 parts by weight of water are added. The reaction mass is held at a reflux temperature of about 95° C. to 100° C. for about 1-½ hours and subsequently stripped at a temperature of 155° C.–160° C., under a vacuum, and filtered. The tiltrate comprises the basic carboxylic magnesium salt characterized by a sulfated ash content of 12.35% (ASTM D-874, IP 163), indicating that the salt contains 200% of the stoichiometrically equivalent amount of magnesium.

Example (A)-8

Added to a vessel are a mixture of 835 parts of mineral oil, 118 parts of a polyisobutenylsuccinic anhydride (where the alkenyl group is 1000 molecular weight and the equivalent weight of the anhydride is 560 based on saponification), 145 parts of a mixture of lower alcohols (butyl and pentyl alcohols), 42.9 parts of a 13.4% aqueous solution of calcium chloride and 100 parts (2.7 equivalents) of lime. The contents are stirred and added is 1000 parts (2 equivalents) of an alkylated benzenesulfonic acid at a rate to maintain the temperature below 80° C. The material is then heated to 150° C. and dried to give a basic calcium sulfonate having 0.7% maximum water content.

Added to a vessel are 1000 parts (1 equivalent) of the above basic calcium sulfonate. While mixing at 46°–52° C. water is added as needed to bring the water content to 0.7%. This is followed by the addition of 200.5 parts of a mixture of lower alcohols (methyl, butyl and pentyl alcohols) and 43.5 pans of a calcium salt of a formaldehyde coupled heptylphenol (phenol to formaldehyde charge ratio of 1:1.45) containing 69% oil. A total of 336.1 parts (9.1 equivalents) of lime are added in four increments and carbonated to a strong base number range of 50–60 for each of the first three increments and to a 45– 55 strong base number range for the final increment. The material is heated to 150° C., dried to a 0.5% maximum water content and filtered. The flitrate, after being adjusted by adding approximately 186 parts of oil, contains 41% oil, 1.77% sulfur, 300 total base number and 40.65% sulfate ash.

Example (A)-9

Added to a vessel are 1000 pans (1 equivalent) of the basic calcium sulfonate from example 1. While mixing at 46°–52° C. water is added as needed to bring the water content to 0.7%. This is followed by the addition of 12.91 parts of the polyisobutenyl-succinic anhydride as described in example 1, 165.3 pans of oil, 332.6 pans of a mixture of lower alcohols (methyl, butyl and pentyl alcohols) and 63.6 pans of a calcium salt of a formaldehyde coupled heptylphenol as described in example 1. A total of 688.6 pans (18.6 equivalents) of lime are added in six increments and carbonated to a strong base number range of 50–60 for each increment at 46°–52° C. The material is heated to 146°–152° C., dried to a 0.5% maximum water content and filtered. The filtrate, after being adjusted by adding approximately 291 pans of oil, contains 41% oil, 1.2% sulfur, 400 total base number and 52.7% sulfate ash.

Example (A)-10

A mixture of 600 parts of mineral oil, 400 pans (0.78 equivalents) of an alkylated benzenesulfonic acid, 771 pans of xylene and 75.2 pans of polyisobutenylsuccinic anhydride as described in example 1 are heated to 46° C. A total of 262 pans (13.1 equivalents) of magnesium oxide are added in three equal increments. After the first increment of magnesium oxide is added, 35.8 pans of glacial acetic acid are added. A total of 94.3 pans of methanol and of 177 parts of water are also added in three equal increments accompanying the three magnesium oxide additions. Each of the three increments of magnesium oxide, methanol and water is separately carbonated at 49°–54° C. Distillates are removed and the reaction mass is filtered. The tiltrate contains 42% oil. 1.55% sulfur, 400 total base number and 46.0% sulfate ash.

Example (A)-11

Added to a vessel are 1000 parts (7.6 equivalents) of dodecylphenol prepared by the alkylation of phenol with polypropylene tetramer. The contents are heated to 38°–54° C. and added are 290 parts (5.6 equivalents) of sulfur dichloride at a rate to maintain the temperature below 71 ° C. The material is nitrogen blown while heating to 88°–93° C. The material is cooled to 60° C. and 400 parts of oil is added. The product obtained contains 27% oil and 6.2% sulfur.

A mixture of 1000 parts (2.6 equivalents) of this unfiltered intermediate material and 118 parts of oil are heated to 60° C. The addition of 51 parts ( 1.4 equivalents) of lime and 25.5 parts of glacial acetic acid gives an exothermic temperature rise that is allowed to go to 82° C. The material is held at 66°–82° C. for 0.5 hours. After cooling to 55° C., 370 parts of methanol and 62.5 parts (1.7 equivalents) of lime are added followed by carbonation to a strong base number range of 30–35. The material is dried by heating to 150° C., filtered and further diluted with 622 parts of oil. This oil diluted tiltrate contains 55% oil, 3.5% sulfur, 90 total base number and 11.0% sulfate ash.

(B) The Inhibitor

Component (B) is not a mere neutralizing agent. This component performs several functions. It functions as a metal passivator or as a complexing agent with the halo acids and halooxy acids to form an innocuous complex. Compositions that are employed as this component comprise (1) at least one aromatic amine, (2) at least one phenolic composition, (3) at least one benzotriazole, and (4) at least one thiadiazole.

(B:1) The Aromatic Amine

Component (B-1) is at least one aromatic amine of the formula

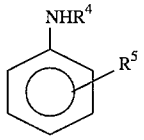

wherein $R^4$ is

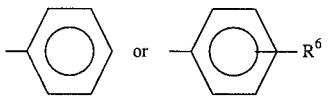

and $R^5$ and $R^6$ are independently a hydrogen or an alkyl group containing from 1 up to 24 carbon atoms. Preferably $R^4$ is

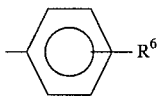

and $R^5$ and $R^6$ are alkyl groups containing from 4 up to about 20 carbon atoms. In a particularly advantageous embodiment, component (B-1) comprises an alkylated diphenylamine such as nonylated diphenylamine of the formula

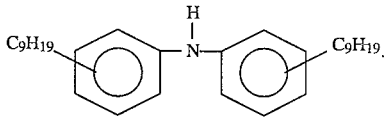

(B-2) The Phenolic Composition

The phenolic compositions having utility in this invention are the hindered or partially hindered phenols and the bridged hindered or partially hindered phenols. One example of this phenolic composition is of the structure

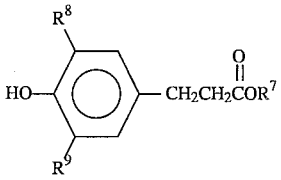

wherein $R^7$ is an aliphatic group containing from 1 to 24 carbon atoms and $R^8$ and $R^9$ are aliphatic groups independently containing from 1 to 12 carbon atoms. Preferably $R^7$ contains from 4 to 18 carbon atoms and most preferably $R^7$ is a stearyl group. Preferably $R^8$ and $R^9$ independently contain from 1 to 8 carbon atoms and most preferably $R^8$ and $R^9$ are t-butyl groups.

A preferred example of this hindered phenol is octadecyl-3-(3,5-di-tert-butyl- 4-hydroxyphenyl)-propionate, available as Irganox®, a product of Ciba Geigy having the formula

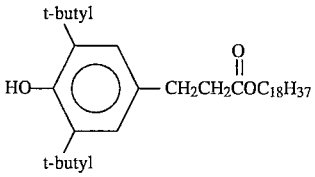

Another phenolic composition has the formula

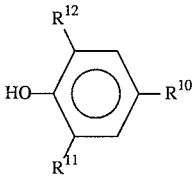

wherein $R^{10}$ is an alkyl group containing from 1 to 8 carbon atoms or

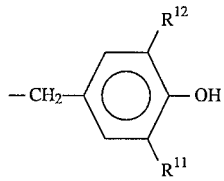

and $R^{11}$ and $R^{12}$ are alkyl groups containing from 1 to 8 carbon atoms. There are two compositions that are commercially available as liquids or low melting solids. When $R^{10}$ is $—CH_3$ and $R^{11}$ and $R^{12}$ are t-butyl groups, the compound is commonly known as butylated hydroxy toluene (BHT), and is commercially available from Uniroyal Chemical Company, Inc. under the trademark Naugard BHT. Another phenol is commercially available under the trademark VANOX 132 (RT Vanderbilt Company) and is generated when $R^{10}$ is sec-butyl and $R^{11}$ and $R^{12}$ are both t-butyl. When $R^{10}$ is

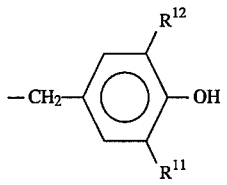

preferably $R^{11}$ and $R^{12}$ are t-butyl groups.

Another phenolic composition is a bridged phenol of the formula

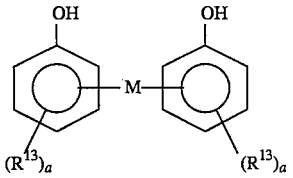

wherein $R^{13}$ is an aliphatic group containing from 1 up to about 24 carbon atoms, a is an integer of 1 to 4, M is —$CH_2$— or $S_x$ wherein x is between 1 and 3.

The following are preparations of bridged alkyl phenols.

Example (B-2)-1

Added to a vessel are 1000 pans (7.6 equivalents) of dodecylphenol prepared by the alkylation of phenol with polypropylene tetramer. The contents are heated to 38°–54° C. and added are 290 pans (5.6 equivalents) of sulfur dichloride at a rate to maintain the temperature below 71° C. The material is nitrogen blown while heating to 143°–149° C. While cooling to 93°–99° C., 788 parts of mineral oil are added. The material is filtered to give a product that contains 42% oil and 5% sulfur.

Example (B-2)-2

Added to a vessel are 798 parts (3 moles) of the dodecylphenol as used in Example (B-2)-1. The contents are heated to 95°–100° C. and 5 parts 93% sulfuric acid is added. Isobutylene gas is added below the surface at 100° C. until the weight gain in the vessel is 168 pans (3 moles). Transferred to another vessel are 890 parts (2.98 moles) of the isobutylated phenol. At 34°– 40° C. 137 pans (1.7 moles) of 37% formaldehyde is added. After the addition is complete, the temperature is increased to 120° C. and held for 3 hours with nitrogen blowing at 1.5 cubic feet per hour. At 83° C. 4 pans (0.05 moles) of 50% aqueous sodium hydroxide is added. The contents are vacuum stripped to 135° C. and 200 millimeters mercury are added and filtered to give a methylene-bridged compound.

(B)(3) The Benzotriazole

The benzotriazole compound is of the formula

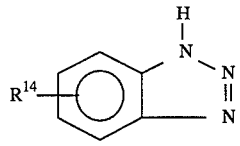

wherein $R^{14}$ is hydrogen a straight or branched-chain alkyl group containing from 1 up to about 24 carbon atoms, preferably 1 to 12 carbon atoms and most preferably 1 carbon atom. When $R^{14}$ is 1 carbon atom the benzotriazole compound is tolyltriazole of the formula

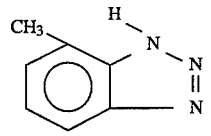

Tolyltriazole is available under the trade name Cobratec TT-100 from Sherwin-Williams Chemical.

A derivative of the above tolyltriazole is of the formula

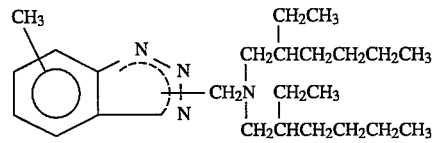

This derivative is available under the trade name Reomet 39 from Ciba-Geigy.

(B)(4) The Thiadiazole

The thiadiazole is represented by the general formula:

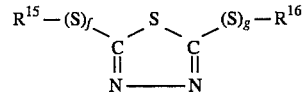

wherein $R^{15}$ and $R^{16}$ are independently hydrogen or a hydrocarbyl and f and g are independently an integer in the range from about 1 to about 8. More preferably f and g are each 2 and $R^{15}$ and $R^{16}$ are independently selected from the group consisting of alkyl, aryl, and aralkyl containing at least 6 carbon atoms. Still more preferably $R^{15}$ and $R^{16}$ are independently an alkyl moiety containing from about 6 to about 24 carbon atoms. Some particularly preferred forms of $R^{15}$ and $R^{16}$ are independently selected from the group consisting of toctyl, dodecyl, nonyl, decyl and ethylhexyl. A particularly preferred thiadiazole is bis-2, 5-tert-octyldithio-1,3,4-thiadiazole and mixtures of such compounds with a similar compound wherein one or both of the (—S, tert-octyl) moieties is replaced with hydrogen and 2-dodecyldithio-5-mercapto-1,3,4-thiadiazole and mixtures of such compounds with a structurally similar compound where one or both of the (—S, dodecyl) moieties is replaced with hydrogen.

Also, as used herein, the terms "hydrocarbyl" or "hydrocarbon-based" denote a radical having a carbon atom directly attached to the remainder of the molecule and having predominantly hydrocarbon character within the context of this invention. Such radicals include the following:

(1) Hydrocarbon radicals; that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical). Such radicals are known to those skilled in the art; examples are (2) Substituted hydrocarbon radicals; that is, radicals containing non-hydrocarbon substituents, in the context of this invention, do not alter the predominantly hydrocarbon character of the radical. Those skilled in the art will be aware of suitable substituents; examples are (3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

Terms such as "alkyl-based radical", "aryl-based radical" and the like have meaning analogous to the above with respect to alkyl and aryl radicals and the like.

The radicals are usually hydrocarbon. Some radicals may be described as lower hydrocarbon, the word "lower" denoting radicals containing up to seven carbon atoms. Such radicals are generally lower alkyl or aryl radicals, most often alkyl.

Generally the compositions of this invention are present as a lubricant formulation such that extended drain oil intervals and prolonged engine life are achieved. Normally the amount of the metal overbased composition (A) employed will be from about 1% up to about 10%, preferably about 2% to about 8% of the total weight of the lubricating composition and the amount of the inhibitor (B) included in the lubricant is from about 0.5% up to about 5%, preferably about 1% to about 5% of the total weight of the lubricating composition.

The invention also contemplates the use of other additives in combination with the lubricant compositions of the method of this invention. Such additives include, for example, viscosity index (VI) improvers, corrosion- and oxidation-inhibiting agents, coupling agents, pour point depressing agents, extreme pressure agents, antiwear agents, color stabilizers and anti-foam agents.

One additive is a zinc salt of a dithiophosphoric acid. Zinc salts of dithiophosphoric acids are often referred to as zinc dithiophosphates, zinc 0,0-dihydrocarbyl dithiophosphates, and by other commonly used names. They are sometimes referred to by the abbreviation ZDP. One of more zinc salts of dithiophosphoric acids may be present in a minor amount to provide additional extreme pressure, anti-wear and anti-oxidancy properties.

In addition to zinc salts of dithiophosphoric acids discussed hereinabove, other additives that may be included, for example, are dispersants, viscosity improvers, pour point depressing agents, extreme pressure agents, anti-wear agents, color stabilizers and anti-foam agents.

Illustrative of the dispersants are (1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent No. 1,306,529 and in many U.S. Patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. Patents:

| | |
|---|---|
| 3,275,554 | 3,454,555 |
| 3,438,757 | 3,565,804 |

(3) Reaction products of alkyl phenols in which the alkyl groups contain at least about 30 carbon atoms with aldehydes (especially formaldehyde) and amines (especially polyalkylene polyamines), which may be characterized as "Mannich dispersants". The materials described in the following U.S. Patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. Patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight. In most instances, they each present at from about 0.1% to about 10% by weight.

Auxiliary extreme pressure agents and corrosion inhibiting agents which may be included in the lubricants of the invention are exemplified by chlorinated aliphatic hydrocarbons such as chlorinated wax and chlorinated aromatic compounds such as dichlorobenzene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purpose of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715.

Anti-foam agents are used to reduce or prevent the formation of stable foam. Typical anti-foam agents include silicones or organic polymers. Additional anti-foam compositions are described in "Foam Control Agents", by Henry T. Kemer (Noyes Data Corporation, 1976), pages 125–162.

Polymeric VI improvers have been and are being used as bright stock replacement to improve lubricant film strength and lubrication and/or to improve engine cleanliness. Dye may be used for identification purposes and to indicate whether a two-cycle fuel contains lubricant. Coupling agents such as organic surfactants are incorporated into some products to provide better component solubilities and improved fuel/lubricant water tolerance.

Anti-wear and lubricity improvers, particularly sulfurized sperm oil substitutes and other fatty acid and vegetable oils, such as castor oil, are used in special applications, such as racing and for very high fuel/lubricant ratios. Scavengers or combustion chamber deposit modifiers are sometimes used to promote better spark plug life and to remove carbon deposits. Halogenated compounds and/or phosphorus-containing materials may be used for this application.

Lubricity agents such as synthetic polymers (e.g., polyisobutene having a number average molecular weight in the range of about 750 to about 15,000 (as measured by vapor phase osmometry or gel permeation chromatography)), polyol ether (e.g., poly(oxyethylene-oxypropylene) ethers) and ester oils (e.g., the ester oils described above) can also be used in the oil compositions of this invention. Natural oil fractions such as bright stocks (the relatively viscous products formed during conventional lubricating oil manufacture from petroleum) can also be used for this purpose. They are usually present in the two-cycle oil in the amount of about 3 to about 20% of the total oil composition.

Diluents such as petroleum naphthas boiling at the range of about 30°–90° (e.g., Stoddard solvent) can also be included in the oil compositions of this invention, typically in the amount of 5 to 25%.

The lubricant compositions for the method of this invention can be added directly to the lubricant. Preferably, however, they are diluted with a substantially inert, normally liquid organic diluent such as mineral oil, naphtha, benzene, toluene or xylene, to form an additive concentrate. These concentrates usually contain from about 30% to about 90% by weight of the compositions of this invention and may contain, in addition, one or more other additives known in the art or described hereinabove. The remainder of the concentrate is the substantially inert normally liquid diluent.

The lubricant composition for the method of this invention provides for a longer duration between oil changes in a gas engine and prolonged engine life. Formulations containing the compositions of this invention were evaluated against a formulation containing a known additive system in side by side diesel engines. The diesel engines utilized were a 4 stroke 12 cylinder Vee form turbocharged air-to-water charged cooled unit having a base of 158.75 mm, a stroke of 190.55 mm, a total swept volume of 45.25 liters and a compression ratio of 9.5: 1.

An engine oil composition is prepared containing the composition of this invention as illustrated as Example 1 in Table I. For a comparison, a base line formulation is utilized which is a passenger car motor oil (PCMO) formulation.

Example 1

Mixed together to achieve solution are 9.59 parts product of Example (A)-8, 1.63 parts product of Example (A)-9, 1.22 parts product of Example (A)- 10, 20.33 parts product of Example (A)-11, 9.43 parts nonylated diphenylamine, 0.05 parts Irganox®, 0.32 parts BHT, 0.81 parts Reomet® 39 and 0.49 parts of a thiadiazole wherein $R^{15}$ and $R^{16}$ are t-nonyl groups and f and g are 2 and identified as Amoco 158 for Amoco, and 0.79 parts product of Example (B-2)- 1. The remainder of the formulation contains diluent oil, a zinc dithiophosphate, extreme pressure agents and a foam inhibitor.

TABLE I

| Diesel Engine Test Results | | | |
|---|---|---|---|
| | PCMO Formulation | Example 1 Formulation | Example 1 Formulation[1] |
| Total Base Number (TBN) | 2.5 | 3.9 | 3.6 |
| Total Acid Number (TAN) | 3.2 | 2.7 | 2.8 |

TABLE I-continued

| | Diesel Engine Test Results | | |
|---|---|---|---|
| | PCMO Formulation | Example 1 Formulation | Example 1 Formulation[1] |
| TBN/TAN | .78 | 1.44 | 1.29 |
| Hours | 411 | 515 | 635 |

[1]a duplicate test

This engine test is terminated whenever the TBN/TAN ratio is at 1. The PCMO formulation ran for 411 hours. However, with a TBN/TAN ratio of below 1, the PCMO formulation had already failed at some point prior to 411 hours. Two tests were conducted with the Example 1 formulation. The first test gave a 515 hour rating. With the TBN/TAN ratio of 1.44, this formulation was capable of running many additional hours. The duplicate test of the Example 1 formulation gave a 635 hour rating. It too could have run longer since the TBN/TAN ratio was 1.29.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of extending lubricant life and engine life in a gas engine that utilizes landfill gas as a fuel which comprises treating deleterious landfill gas fuel components and combustion products of said landfill gas fuel with a lubricant composition comprising a major amount of an oil of lubrication viscosity and a minor amount of an additive composition comprising;

(A) from about 1% up to about 10% of the total weight of the lubricating composition of at least one metal overbased composition and (B) from about 0.5 % up to about 5 % of the total weight of the lubricating composition of at least one oxidation inhibitor comprising (1) at least one aromatic amine, (2) at least one phenolic composition, (3) at least one benzotriazole, and (4) at least one thiadiazole.

2. The method of claim 1 wherein the metal overbased composition (A) is selected from the group consisting of (a) a metal overbased phenate derived from the reaction of an alkylated phenol wherein the alkyl group has at least 6 aliphatic carbon atoms optionally reacted with formaldehyde or a sulfurization agent or mixtures thereof, (b) a metal overbased sulfonate derived from an alkylated aryl sulfonic acid wherein the alkyl group has at least 15 aliphatic carbon atoms, (c) a metal overbased carboxylate derived from fatty acids having at least 8 aliphatic carbon atoms and (d) a metal overbased salicylate of the formula (V)

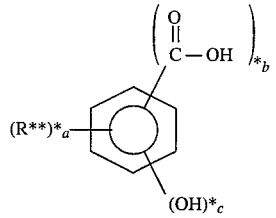

wherein R** is an aliphatic group containing at least 4 to about 400 carbon atoms, a is an integer of from 1 to 3, b is 1 or 2, and c is zero, 1 or 2.

3. The method of claim 2 wherein the metal is an alkali or alkaline earth metal.

4. The method of claim 2 wherein the alkaline earth metal is calcium or magnesium.

5. The method of claim 2 wherein the alkali metal is sodium.

6. The method of claim 1 wherein the metal overbased composition is treated with a borating agent.

7. The method of claim 1 wherein within (B)(1) the aromatic amine is of the formula

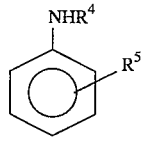

wherein $R^4$ is

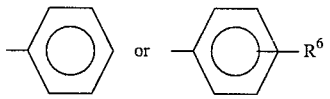

and $R^5$ and $R^6$ are independently a hydrogen or an alkyl group containing from 1 up to about 24 carbon atoms.

8. The method of claim 7 wherein within (B)(1) $R^4$ is

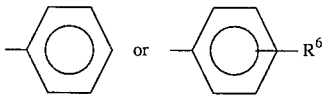

and $R^5$ and $R^6$ are alkyl groups containing from 4 to 18 carbon atoms.

9. The method of claim 7 wherein within (B)(1) the aromatic amine is

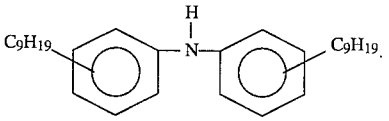

10. The method of claim 1 wherein within (B)(2) the phenolic composition comprises

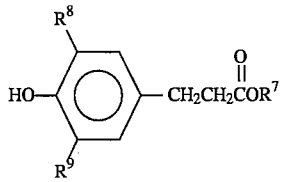

wherein $R^7$ is an aliphatic group containing from 1 to 24 carbon atoms, $R^8$ and $R^9$ are aliphatic groups independently containing from 1 to 12 carbon atoms,

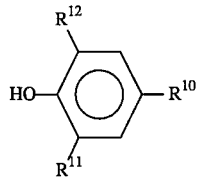

wherein $R^{10}$ is an alkyl group containing from 1 to 8 carbon atoms or

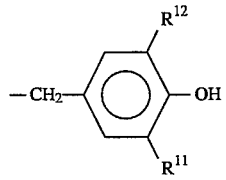

and $R^{11}$ and $R^{12}$ are alkyl groups containing from 1 to 8 carbon atoms, or

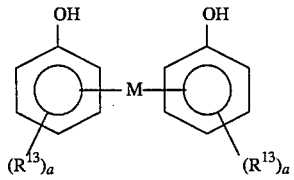

wherein $R^{13}$ is an aliphatic group containing from 1 up to about 24 carbon atoms, a is an integer of 1 to 4, M is —$CH_2$— or $S_x$ wherein x is between 1 and 3.

11. The method of claim 10 wherein within (B)(2), $R^7$ contains from 4 to 18 carbon atoms and $R^8$ and $R^9$ independently contain from 1 to 8 carbon atoms.

12. The method of claim 10 wherein within (B)(2), $R^7$ is a stearyl group and $R^8$ and $R^9$ are t-butyl groups.

13. The method of claim 10 wherein within (B)(2), $R^{10}$, $R^{11}$ and $R^{12}$ are alkyl groups containing from 1 to 6 carbon atoms.

14. The method of claim 10 wherein within (B)(2), $R^{10}$ is

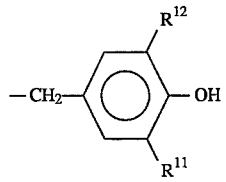

and $R^{11}$ and $R^{12}$ are alkyl groups containing from 1 to 6 carbon atoms.

15. The method of claim 13 wherein $R^{10}$ is methyl and $R^{11}$ and $R^{12}$ are t-butyl groups.

16. The method of claim 14 wherein $R^{11}$ and $R^{12}$ are t-butyl groups.

17. The method of claim 10 wherein within (B)(2), $R^{13}$ is a dodecyl group, a is 1, M is 5 and x is 1.

18. The method of claim 10 wherein within (B)(2), $R^{13}$ is a dodecyl group, a is 1 and M is —$CH_2$—.

19. The method of claim 1 wherein within (B)(3) the benzotriazole is of the formula

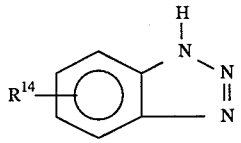

wherein $R^{14}$ is hydrogen or an alkyl group of 1 up to about 24 carbon atoms.

20. The method claim 19 wherein within (B)(3), $R^{14}$ is hydrogen or an alkyl group containing from 1 up to about 8 carbon atoms.

21. The method of claim 19 wherein within (B)(3), $R^{14}$ is a methyl group.

22. The method of claim 1 wherein within (B)(4) the thiadiazole is of the formula

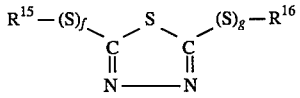

wherein $R^{15}$ and $R^{16}$ are independently hydrogen or a hydrocarbyl and f and g are independently an integer in the range of from about 1 to about 8.

23. The method of claim 22 wherein within (B)(4) f and g are each 2 and $R^{15}$ and $R^{16}$ are independently selected from the group consisting of alkyl, aryl, and aralkyl containing at least 6 carbon atoms.

24. The method of claim 23 wherein within (B)(4) $R^{15}$ and $R^{16}$ are independently an alkyl moiety containing from about 6 to about 24 carbon atoms.

25. The method of claim 24 wherein within (B)(4) $R^{15}$ and $R^{16}$ are independently selected from the group consisting of t-octyl, dodecyl, nonyl, decyl and ethylhexyl.

26. The method of claim 22 wherein (B)(4) is bis-2,5-tert-octyldithio- 1,3,4-thiadiazole.

27. The method of claim 22 wherein (B)(4) is 2-dodecyldithio-5-mercapto- 1,3,4-thiadiazole.

* * * * *